US011414845B2

(12) United States Patent
Grimaldi

(10) Patent No.: US 11,414,845 B2
(45) Date of Patent: Aug. 16, 2022

(54) PREFABRICATED SANITARY MODULAR KIT

(71) Applicant: HEALTH PROGRESS S.R.L., Naples (IT)

(72) Inventor: Folco Grimaldi, Naples (IT)

(73) Assignee: HEALTH PROGRESS S.R.L., Naples (IT)

( * ) Notice: Subject to any disclaimer, the term of this patent is extended or adjusted under 35 U.S.C. 154(b) by 88 days.

(21) Appl. No.: 16/975,278

(22) PCT Filed: Feb. 21, 2019

(86) PCT No.: PCT/IB2019/051416

§ 371 (c)(1),
(2) Date: Aug. 24, 2020

(87) PCT Pub. No.: WO2019/166924

PCT Pub. Date: Sep. 6, 2019

(65) Prior Publication Data

US 2020/0407954 A1 Dec. 31, 2020

(30) Foreign Application Priority Data

Mar. 1, 2018 (IT) ..... 102018000003171

(51) Int. Cl.
*E03C 1/01* (2006.01)
*E03D 1/00* (2006.01)
*E04H 1/12* (2006.01)

(52) U.S. Cl.
CPC ..... *E03C 1/01* (2013.01); *E03D 1/003* (2013.01); *E04H 1/12* (2013.01)

(58) Field of Classification Search
CPC ..... E04H 1/12; E04H 1/1216
(Continued)

(56) References Cited

U.S. PATENT DOCUMENTS 1,859,859 A * 5/1932 Zook ..... E03C 1/01 4/596
2,084,793 A * 6/1937 Denison ..... E03C 1/01 4/597

(Continued)

FOREIGN PATENT DOCUMENTS

CH 632 550 10/1982
CN 204418331 6/2015

(Continued)

OTHER PUBLICATIONS

International Search Report for PCT/IB2019/051416 dated Jun. 7, 2019, 4 pages.

(Continued)

*Primary Examiner* — Benjamin R Shaw
(74) *Attorney, Agent, or Firm* — Nixon & Vanderhye

(57) ABSTRACT

Disclosed is a prefabricated modular kit, reversibly assemblable, adapted for the quick installation of a bathroom, including: A) lower module with: toilet bowl; discharge device; roll-holder; container; tiltable door; sprayhead; water connections; discharge duct; B) intermediate module with: sink surface; faucet; mixer; soap dispenser; hands-dryer; C) upper module with: container; foldable arm with showerhead; D) floor module with shower plate; E) ceiling module with light and exhaust fan; F) side wall module; G) door; the modules having the systems ready for connecting between the modules themselves and between the modules and the pre-existing wall.

19 Claims, 6 Drawing Sheets

(58) Field of Classification Search
USPC ..... 4/663
See application file for complete search history.

(56) References Cited

U.S. PATENT DOCUMENTS 2,611,134 A * 9/1952 Jarrett ..... E03D 11/12 4/300
2,650,368 A * 9/1953 Evans ..... E03C 1/01 312/304
2,907,048 A * 10/1959 Gould ..... E03C 1/01 4/663
3,047,106 A * 7/1962 Callahan ..... E04B 1/34869 4/252.2
3,110,907 A * 11/1963 King ..... E04B 1/34869 4/300
3,594,825 A * 7/1971 Reid ..... B61D 35/00 4/663
3,978,529 A * 9/1976 Krafft ..... A47K 4/00 4/663
4,142,255 A * 3/1979 Togni ..... E03C 1/01 4/546
5,253,373 A * 10/1993 Tsipov ..... E03C 1/01 4/447
5,438,713 A * 8/1995 Clarke ..... E03C 1/01 4/663
6,185,759 B1 * 2/2001 Staudenmayer ..... A47K 17/026 4/663
7,984,520 B2 * 7/2011 Hall ..... A47K 11/026 4/663
2012/0198609 A1 * 8/2012 Grimaldi ..... E03D 11/12 4/420
2015/0289732 A1 10/2015 Ito et al.

FOREIGN PATENT DOCUMENTS

GB 1127314 9/1968
GB 2 003 955 3/1979
WO 95/02736 1/1995
WO 2015/135202 9/2015

OTHER PUBLICATIONS

Written Opinion of the ISA for PCT/IB2019/051416 dated Jun. 7, 2019, 10 pages.

* cited by examiner

PREFABRICATED SANITARY MODULAR KIT

FIELD OF THE ART

The present invention operates in the field of prefabrication and in particular of sanitary environments such as sanitary services; in detail it proposes a complete bathroom made of prefabricated modules, reversibly assemblable, in order to install a bathroom in a limited space and in a brief time period.

PRIOR ART

The bathroom is a room housing sanitary devices, widespread throughout most of the world. In modern homes, it is the site of the toilet bowl, the sink and the tub and/or the shower plate and, in the countries where it is diffused, the bidet. When the only accessories are the toilet bowl and the sink, it is specifically termed lavatory.

After the époque of the Ancient Greeks, and then the Romans, in which the bathroom was intended as an important public place not only for hygiene but also for socializing, in the Middle Ages the technical knowledge for building new systems and sewerage/drainage was lost, and there came to be widespread the incorrect belief that water penetrated into the pores of the skin, causing infectious diseases; this led to the complete decline of the public baths. Only in the 17th century did personal hygiene start to reaffirm itself and there was a rebirth of baths, and with the 20th century also architectural design was involved with hygienic-sanitary needs, making the bathroom become first an external appendage of the home before returning to occupy a room with the most prestigious homes. With the Second World War, the bathroom once again started to be part of private homes on a wide scale, also stimulating the interest of planners and architects.

The need to accelerate and rationalize the construction of large-size structures has actually contributed to the diffusion in recent years of an innovative construction method: the prefabricated bathroom. The latter is constituted by modules which are made in a special industrial factory and subsequently assembled at the site of destination, considerably reducing the building times.

The increasing need to save space within homes has led to various space-saving inventions, such as the patent US 2015 28 97 32 (A1) with title "Ready-to-assemble toilet", which claims an independent bathroom with sewer connection, or the patent WO 2015 13 52 02 (A1) which describes a multipurpose toilet bowl that integrates numerous compartments in order to contain the toilet paper, the toilet brush and an object-holder compartment. Also the toilet bowl itself can be "hidden", as in the patent CN 2044 18 33 1 (U) which describes a toilet bowl re-closeable in a simple space-saver furniture piece, or as in the patent US 2012 19 86 09 (A1) which describes a foldable bellows-like toilet bowl.

However, none of the existing inventions seems to resolve the problem of making an additional bathroom in the home or in any other environment, without having to carry out difficult renovation works and without having to reserve considerable available surface area to these spaces.

Therefore, the object of the present invention is to propose a complete bathroom in the form of a modular kit, with dimensions usually useful for the installation of only the shower box, provided with hidden sanitary appliances and with prefabricated electrical and hydraulic systems, easily and reversibly mountable and positionable, which only requires connecting to the home power grid and water supply system by means of suitable adapted provided with the kit.

DESCRIPTION OF THE INVENTION

According to the present invention, a prefabricated modular kit, reversibly assemblable, is attained that is adapted for the quick installation of a bathroom, characterized by space-saving sanitary appliances and by possible additional comforts, falling within the dimensions of a common shower box.

Advantageously, there is only one wall equipped with the sanitary appliances and it is constituted by the superimposition of only three modules, a lower module, an intermediate module and an upper module, which already have the internal arrangement of the water connections, the electrical connections and the discharge pipe of the toilet. The superimposition of one module on the other, therefore, is quick and requires only small technical expedients in order to carry out the system connections required by the specific case, which represent a commonplace operation for any installer.

The lower module, based on the system characteristics of the property in which it is desired to install the present bathroom, can be advantageously provided with the water connections placed on its rear surface or on one of the two lateral surfaces. With regard to the discharge piping of the toilet, this can be arranged on the back or on the side of the lower module, for the connection to the pre-existing wall, at which one wishes to install the bathroom. In the case of self-supporting installations, i.e. without being directly connected to the pre-existing wall, the discharge piping of the toilet can be arranged for discharging downward, i.e. towards the floor.

More in detail, the lower module, in addition to the toilet bowl, preferably provided with toilet cover, is provided with a discharge device for activating the flushing; a roll-holder for containing a common toilet paper roll; a container integrated in the volume of said lower module and accessible by means of a common door, in which for example the reserve toilet paper rolls can be stored; a tiltable door adapted to contain the brush or the hydro-brush for cleaning the bowl and integrated in the volume of said lower module; a sprayhead laterally placed with respect to said toilet bowl adapted to be grasped by the user in order to act as bidet. In addition to or in substitution of the sprayhead, a water spray can be provided directly within the toilet bowl, still in order to act as bidet.

In some possible embodiments, the toilet bowl is of bellows type or partially extractible so as to increase the usable surface area of the bathroom when the toilet bowl is not used.

The intermediate module, advantageously, comprises:

- at least one sink surface of overturnable type or hidden bellows type, adapted to take on a first closed configuration in which the intermediate module has a completely flat surface. By rotating around its lower side, the sink surface is adapted to take on a second open configuration in which it is substantially parallel to the floor and the elements necessary for using the sink are made accessible to the user, i.e.:
- at least one faucet;
- the mixer;
- at least one soap dispenser preferably operating by means of proximity sensor;

at least one hands-dryer of air jet type, also operating with proximity sensor.

Advantageously, the intermediate module can be installed with the sink surface adapted to be overturned on the same side as the toilet bowl placed on the underlying lower module, or, in the case of "stand-alone" installations, the intermediate module can be installed in order to be usable from the other side. In this manner, advantageously, one single kit of the present invention can be simultaneously used by two users, one on one side who uses the toilet bowl and one on the other side of the structure who uses the sink.

The upper module is advantageously provided with at least one container, made within the volume of said upper module, made accessible by means of at least one openable door at which at least one mirror is installed. As already stated for the intermediate module, also the upper module can be connected to the intermediate module such that it can be used on the same side of the latter or on the opposite side.

Above or on the side of said upper module, the installation of a shower module is provided which is constituted by at least one foldable arm, adapted to be placed back in a first closed configuration in which it is entirely comprised in the volume of said shower module. By rotating with respect to the horizontal plane, by means of suitable hinges, said foldable arm reversibly takes on a second open configuration in which its distal end is placed on the vertical of a shower plate installed on the lower part and described hereinbelow. The distal end of said foldable arm has, advantageously, a showerhead adapted to act as a shower when in said second open configuration.

Advantageously, said shower module can be installed in one direction or in the other so as to have the arm adapted to be extended towards the opening side of said container or towards the opposite side.

Below these just-described modules, said kit also comprises a floor module, constituted by a common shower plate provided with suitable drain, adapted to be positioned below said lower module on the side where said foldable arm is adapted to be opened.

If it was necessary to completely close the bathroom space, said kit can advantageously also comprise a ceiling module, adapted to be installed above said upper module and comprising at least one light and at least one exhaust fan adapted to be reversibly turned on upon command of a common switch or in an automatic manner, when a suitable sensor detects the presence of a user.

Said kit can comprise at least one side wall module or a plurality of side wall modules, based on the planimetric characteristics of the site where it is desired to install the bathroom. Said side wall modules are adapted to be installed on the side and in front of said lower, intermediate, upper and shower modules. These can be made of any one opaque, transparent or translucent material.

In a preferred embodiment, said side wall modules are provided with any one reversible mechanical coupling system adapted to allow the quick, stable and reversible coupling of a corresponding covering panel made of any one material. Advantageously, in this manner, the aspect of the bathroom can radically change with little effort, actually making the covering material interchangeable.

To complete the kit, a door is installed at one of said side wall modules in order to allow access to said bathroom.

In some embodiments, said door can be advantageously provided with a locking device for the lock. Such element can be useful in various situations. For example, outside the bathroom, a scanner can be installed of any type that allows access to the bathroom, and hence unlocking said locking device, only to those possessing a pre-established access code. This can be particularly useful in the case of bathrooms reserved for employees of a store or for airport and station bathrooms where the scanning of the travel ticket is required.

Another example is that of in-line bathrooms, in which, for an optimization of the cleaning operations, it is preferable to configure the locking devices so that they allow access to one of the bathrooms only if the preceding bathroom is occupied. In such a manner, on days when they are not very frequented, it may happen that the final bathrooms of the line are not used and hence do not require cleaning.

Said kit can advantageously comprise a great number of additional elements that render the present invention adaptable to any context.

Such elements comprised in the kit and freely installable in any one of its modules are the following:

- a display placed inside said bathroom, adapted to report useful information for the user inside the bathroom such as the information relative to the current water consumption, or, in the case of stations, travel information;
- a plurality of lights, actuatable by means of a suitable button or through an automated system, installed at least on said ceiling module, adapted to change color for chromotherapeutic purposes;
- at least one audio speaker, preferably a plurality of audio speakers actuatable by means of a suitable button or through an automated system for the diffusion of music within said bathroom;
- at least one external light, placed at said door, connected to a common sensor adapted to recognize the presence of a user inside the bathroom, adapted to signal, by means of pre-established colors, the presence of a user inside the bathroom or lack of user presence therein;
- the arrangement of the electrical and hydraulic system adapted for connecting a common washing machine, defining a laundry space inside the bathroom.

In the version for handicapped people on wheelchairs, the toilet bowl is of foldable bellows type and the internal arrangement of the bathroom is such to allow a complete rotation of the wheelchair without impacting any component of the bathroom and allow the approach to the sanitary appliances that is completely safe for the user. Suitable grip handles can also advantageously be included for wheelchair users. If the floor module creates a step that is hard to overcome for a wheelchair user, in this version of the kit said floor module can advantageously include a reversible extractible ramp that assists the handicapped user in going beyond said step in accordance with the current laws for handicapped user accessibility.

In one of the multiple embodiments of the present invention, moreover, the floor module is provided with a lifting system adapted to adjust the height thereof, which during kit assembly step can determine a height of the floor module and hence of the entire bathroom from a minimum of 3 cm to a maximum of 30 cm. Due to this possibility, the installation of bathrooms in sequence one next to the other is made more manageable from a plant standpoint. The arrangement of the bathrooms at heights that are decreasing the more one approaches the pre-existing wall allows creating the suitable slope for the discharge duct of the WC even of the bathroom furthest from the wall.

Advantageously, said kit can also be provided with a plurality of radiators, preferably with infrared radiation, alternatively connected to a dehumidifier or to a steam generator, adapted to allow the user to use said bathroom as a dry sauna or a steam room or Turkish bath. The combined activation of radiators and dehumidifier or of radiators and steam generator is advantageously controlled by a switch inside said bathroom or, preferably, remotely by means of a remote and programmable automated starting system.

Advantageously, said kit can also be provided with a plurality of internal diffusers adapted to spread in the air, in a controlled and programmable manner, a particular aroma or a deodorant or an essence with therapeutic functions.

In a bathroom module complete with ceiling and provided with hermetic seals between one module and the next, a shower jet of hygienizing liquid can also be arranged which permeates each surface, cleaning it. The connectors between the walls can be advantageously curved so as to allow conveying all the sprayed liquid towards the drain of the shower plate and hence self-cleaning and self-hygienizing the bathroom, without the intervention of cleaning personnel.

Advantageously, said kit is provided with at least four wheels, placed in contact with the pre-existing floor at the four vertical edges of the structure, adapted to allow the easy positioning of the bathroom once assembled and adapted to be locked in order to allow the connection of the bathroom to the electrical, hydraulic and drain systems of the building.

In a further assembly version of the kit, subject of the present invention, an installation of the lower module can be provided that is non-aligned with respect to the intermediate module, as illustrated hereinbelow.

The advantages of the invention proposed herein are evident in light of the present description and will be clearer from the description of the preferred embodiments and from the enclosed figures.

DESCRIPTION OF THE FIGURES

The invention will be described hereinbelow in at least one preferred embodiment by way of a non-limiting example with the aid of the enclosed figures, in which:

In FIG. 4(*a*) the modules 1-2-3-5 are abutted against the wall 10. In FIG. 4(*b*) the modules 1-2-3-5 are cantilevered with respect to the wall 10 on the left side, while in FIG. 4(*c*) they are cantilevered on the other side.

FIG. 5(*a*) shows all the modules 1-2-3-4-5 facing the same side. FIG. 5(*b*) shows the floor module 4, the lower module 1 and the shower module 5 facing the opposite side with respect to the intermediate module 2 and upper module 3. FIG. 5(*c*) shows all the modules 2-3-4-5 facing one side except for the lower module 1. FIG. 5(*d*), finally, illustrates the possibility of assembling the lower 1, intermediate 2 and upper 3 modules towards one side and the floor module 4 and the shower module 5 facing the other side.

In FIG. 6(*a*) the lower module 1 has the rear surface 1.*b* next to the pre-existing wall 10. The arrangement of the hydraulic systems 20-21 then starts from said rear surface 1.*b* and is extended towards the upper surface 1.*d*, from which it reaches the overlying modules. In FIG. 6(*b*), the connection of the module 1 to the wall 10 is cantilevered. The water connections 20-21 are then arranged on the lateral surface 1.*c* before then being extended upward in order to reach the overlying modules.

DETAILED DESCRIPTION OF THE INVENTION

It is clear, from the preceding description and from the just-illustrated figures, that there are numerous embodiments of the present invention and they are in turn aimed to resolve any situation regarding spaces and systems, for any type of setting whether public or private.

Figure 1:
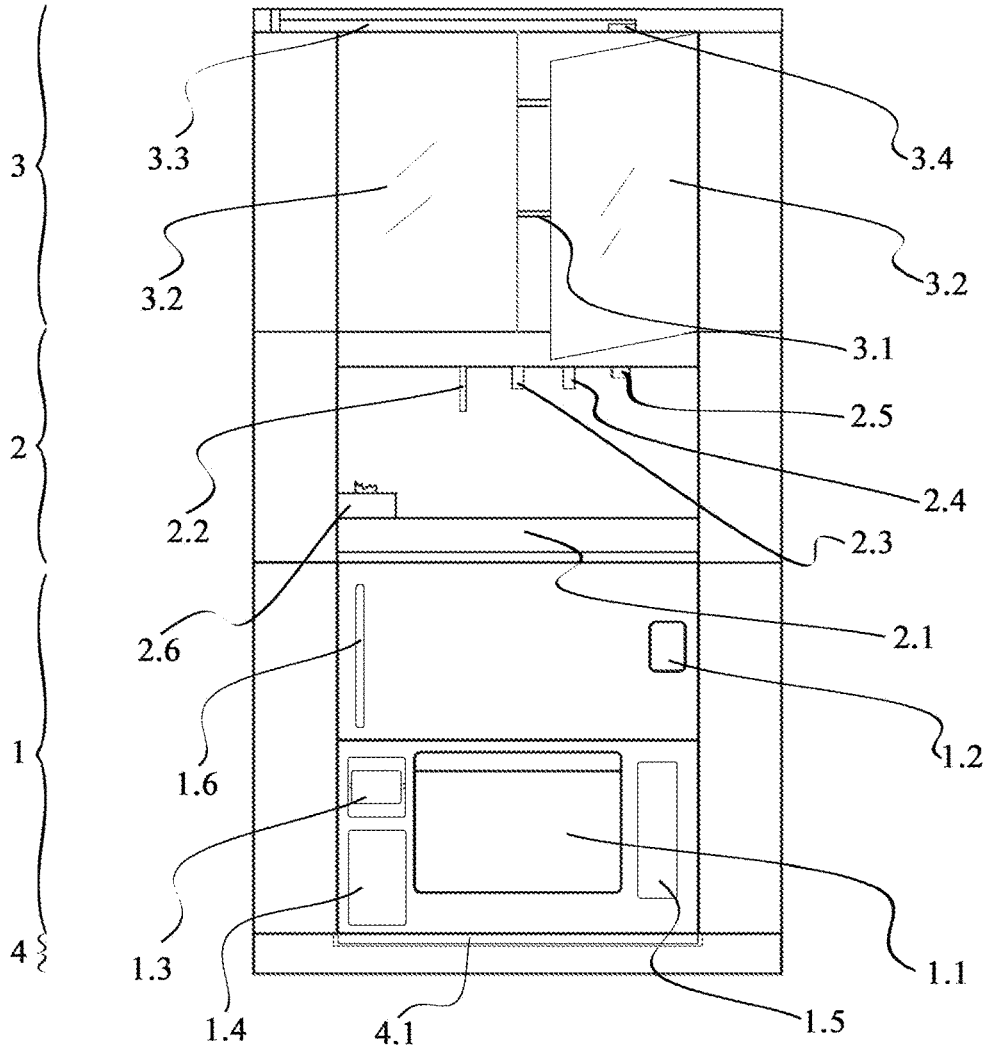
FIG. 1 shows a front view of a possible embodiment of the bathroom by means of the kit of the present invention. The lower module 1 with the bowl 1.1, the discharge device 1.2, the toilet paper holder 1.3, the container 1.4, the tiltable door 1.5 and the sprayhead 1.6 to be used as bidet are observable. Below, the floor module 4 constituted by the shower plate 4.1 is visible. Above, the intermediate module 2 is installed, provided with sink surface 2.1, faucet 2.2, mixer 2.3, soap dispenser 2.4 and fan hands-dryer 2.5. Also the wipes dispenser 2.6 is visible. Above, the upper module 3 is installed with the container 3.1 behind the mirror 3.2 and the shower module 5 with the foldable arm 5.1 that terminates with the showerhead 5.2 of the shower.
Figure 2:
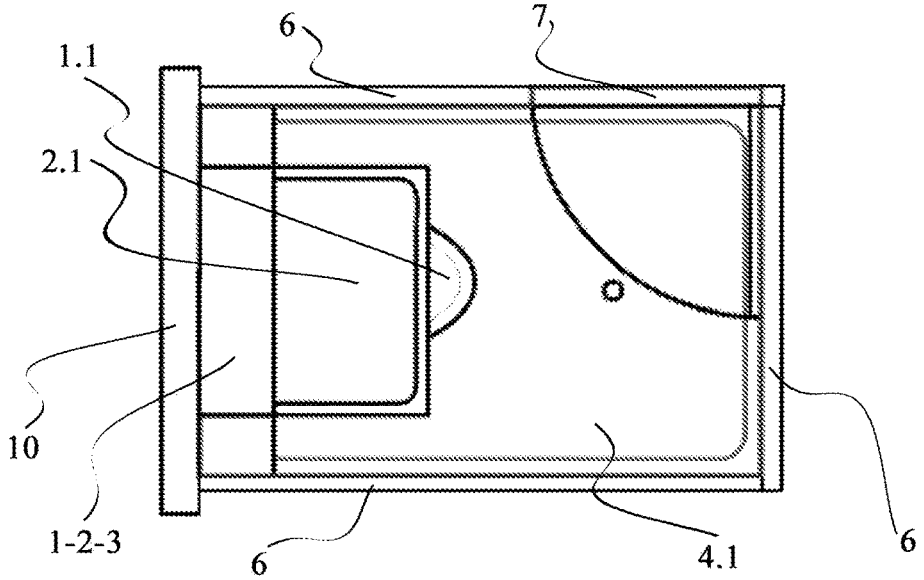
FIG. 2 shows the top view of the mounted kit in which the modules 1-2-3-5 are on the left, at the pre-existing wall 10 and one sees the sink surface 2.1 placed above the bowl 1.1. Also visible is the floor module 4 constituted by the shower plate 4.1 and three wall modules 6 that close the room of the bathroom. In a wall module 6, the door 7 is installed.
Figure 3:
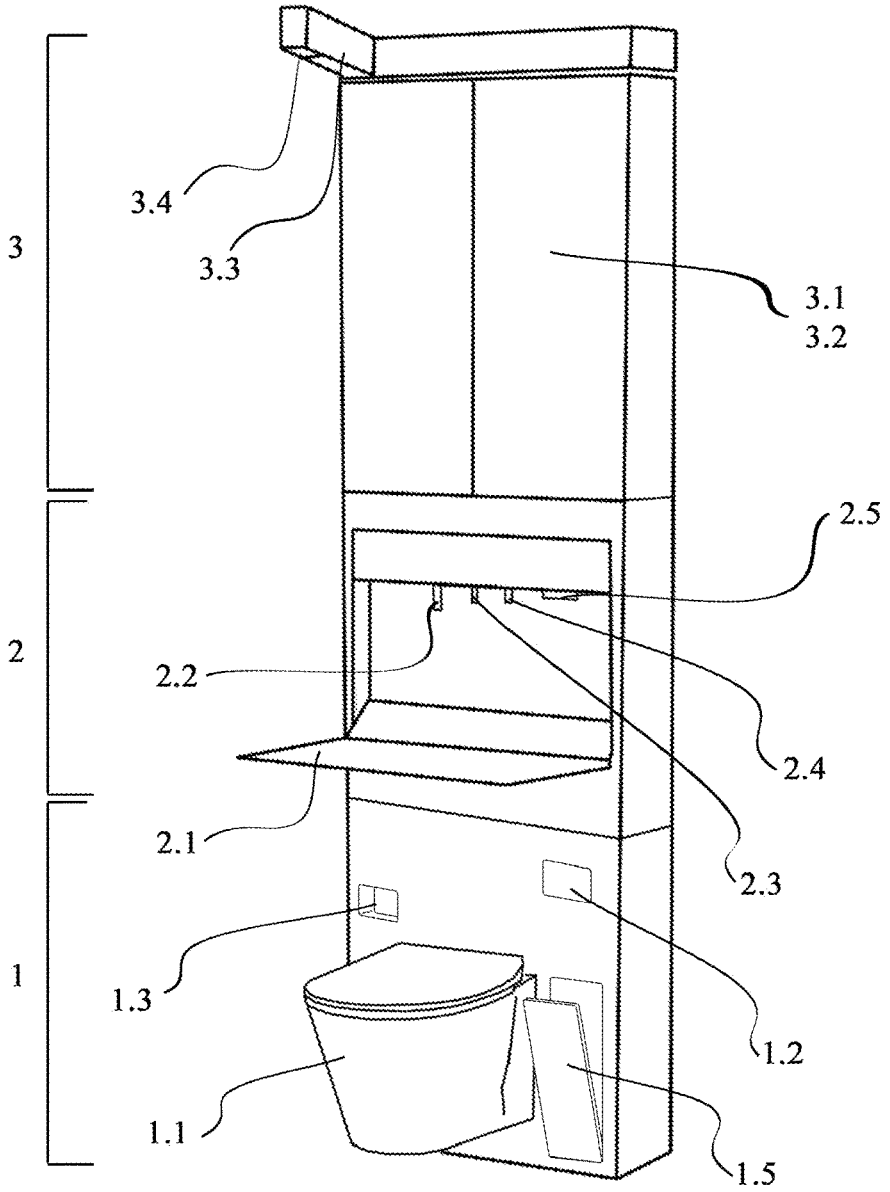
FIG. 3 shows a three-dimensional view of the assembled kit in which the same components are seen as in the preceding FIG. 1.

The preferred embodiment for private settings, hence homes and the like, is constituted by the kit which comprises a lower module 1, an intermediate module 2, an upper module 3, a floor module 4, a shower module 5, a ceiling module and a plurality of side wall modules 6. As seen in FIG. 1, which represents the preferred embodiment, the lower module 1 is provided with: toilet bowl 1.1, discharge device 1.2, roll-holder 1.3, container 1.4 integrated in the thickness of the module 1, tiltable door 1.5 containing the brush or the hydro-brush for cleaning the toilet bowl 1.1 and sprayhead 1.6 which acts as bidet possibly in addition to or in substitution of a water spray within the toilet bowl.

In the thickness of the lower module, the electrical and hydraulic systems and the discharge pipe 30 are already preformed.

Figure 4:
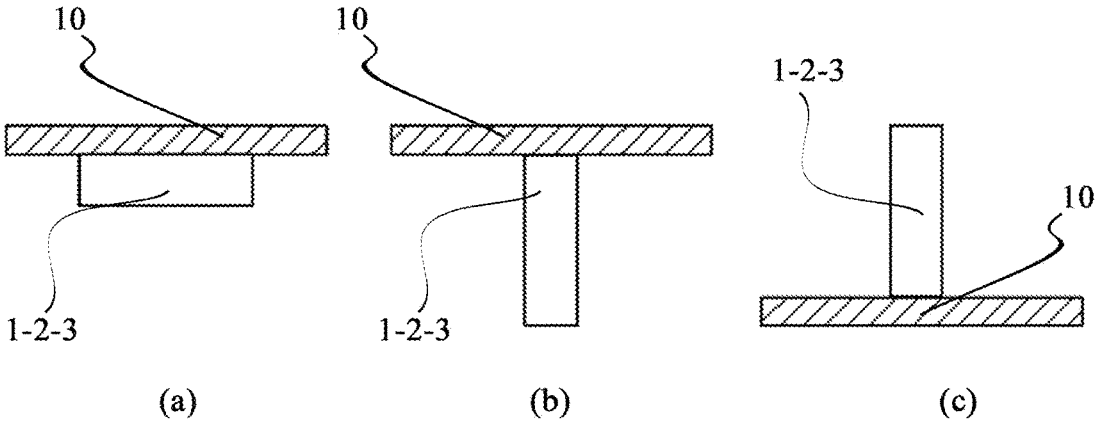
FIG. 4 shows the possibilities of mounting the modules 1-2-3-5 of the kit, subject of the present invention, with respect to the pre-existing wall 10.
Figure 5:
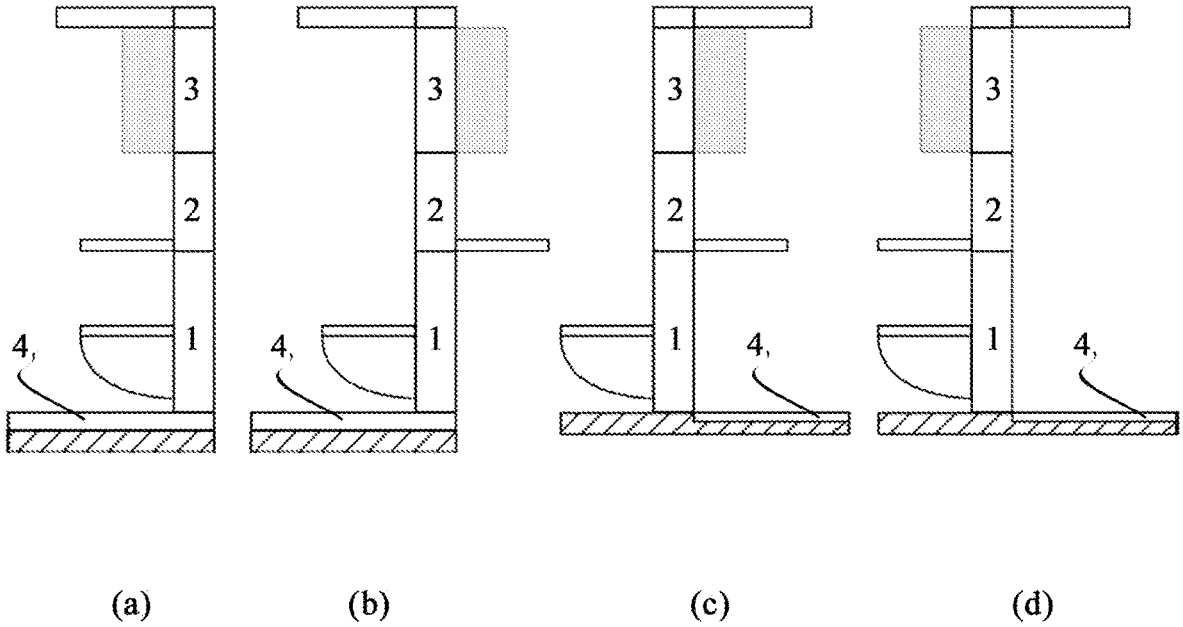
FIG. 5 shows the possibilities of assembling together the floor 4, lower 1, intermediate 2, upper 3 and shower 5 modules.
Figure 6:
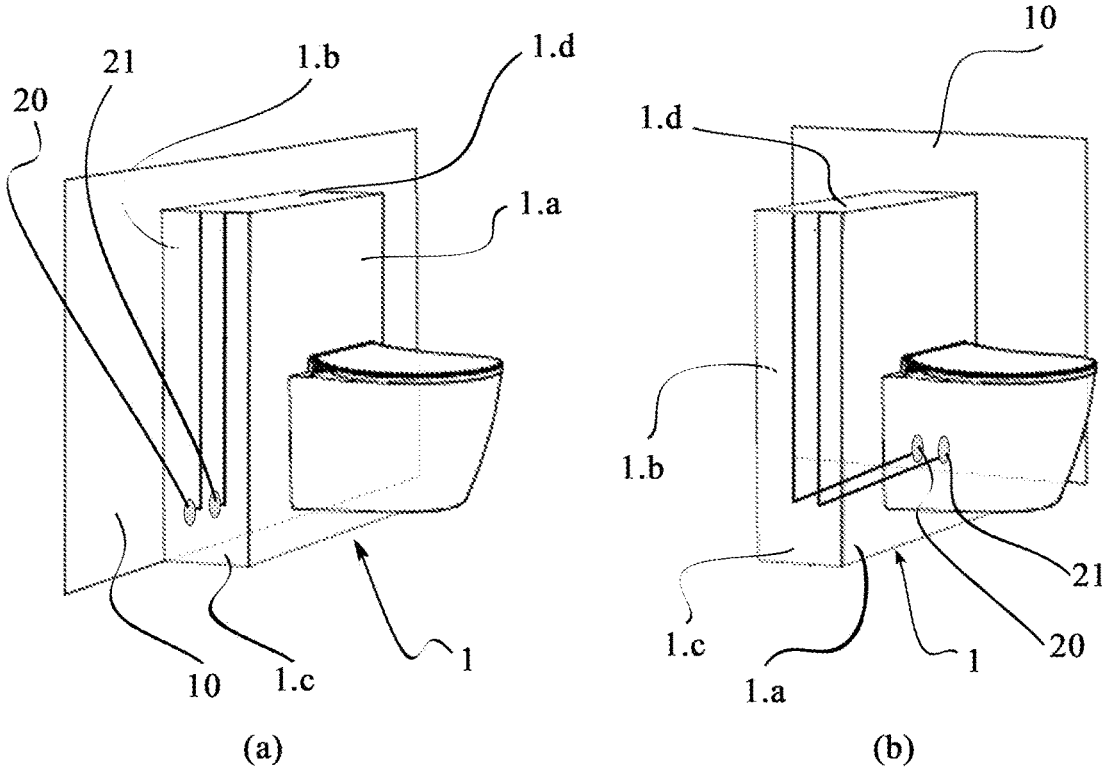
FIG. 6 shows the possibilities for making the lower module 1 with respect to the required water connections.
Figure 7:
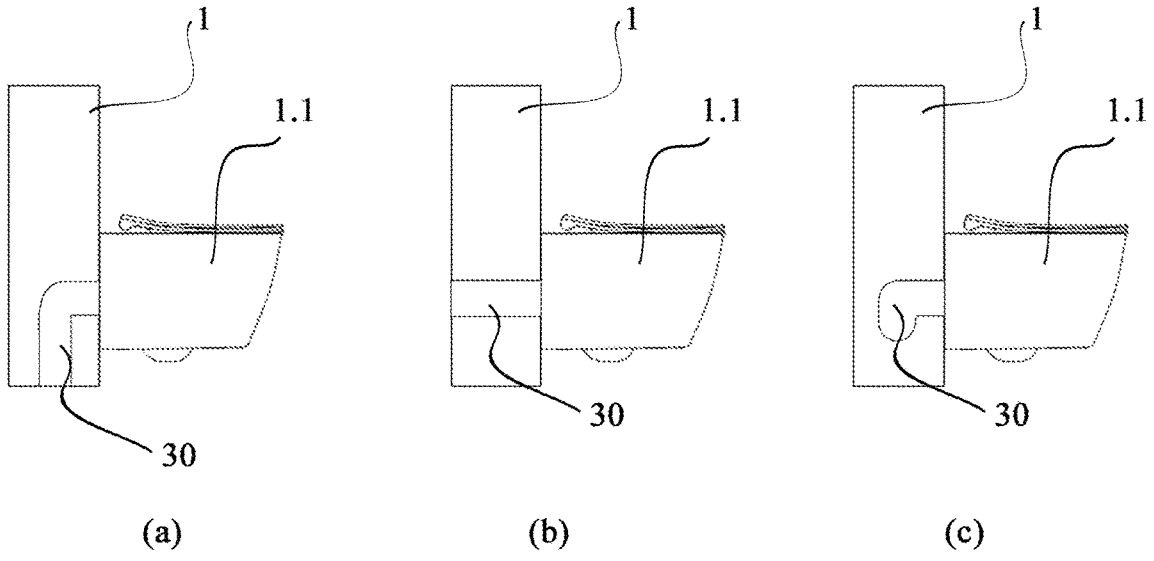
FIG. 7 shows the scheme of the discharge piping 30 of the lower module 1 which, in the case of FIG. 7(*a*) is on the floor, in the case of FIG. 7(*b*) is towards the pre-existing wall 10 which is adjacent to the rear surface 1.*b* of the lower module 1 and, in the case of FIG. 7(*c*) is towards the lateral surface 1.*c* of the lower module 1, for cantilevered installations.
Figure 8:
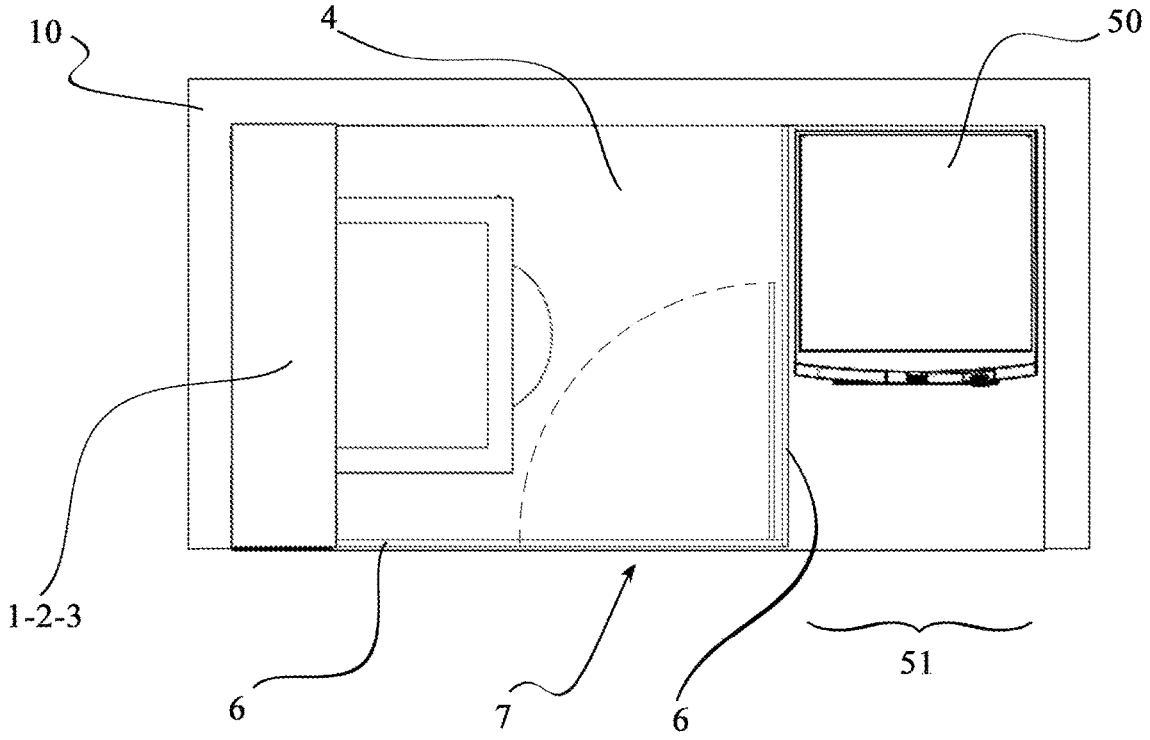
FIG. 8 shows the plan view of a bathroom, installed according to the present invention, in which a small laundry space 51 is present, provided with washing machine 50.

The design of the kit will be such to be adapted to the system arrangements of the bathroom installation site. For this reason, the water connections 20-21 can be arranged on the rear surface 1.*b* of the lower module 1 or on one of its lateral surfaces 1.*c*. This allows the installation of the bathroom both adjacent to the pre-existing wall 10 of the installation site (FIG. 4(*a*)), and "cantilevered" (FIGS. 4(*b*) and 4(*c*)).

Analogously, the discharge pipe 30 of the toilet bowl 1.1 will be preformed, adapted to be connected in fecal connection on the rear surface 1.*b* of the lower module 1, on one of the lateral surfaces 1.*c* or towards the floor.

The intermediate module 2 will be provided on its lower surface with water connections 20-21 already arranged for being connected with the lower module 1. Said lower module 1 has a sink surface 2.1 of hidden overturnable type or possibly bellows type.

More in detail, when the user is using the toilet bowl 1.1, presumably, the sink surface 2.1 will be in a first closed configuration, i.e. the intermediate module 2 has a completely flat surface.

Once the use of the toilet bowl 1.1 has terminated, if it is bellow foldable the user will bring it into the closed or folded configuration and will make said sink surface 2.1 rotate around its lower side, causing it to take on a second open configuration in which the sink surface 2.1 is substantially parallel to the floor and the following are made accessible: the faucet 2.2, the mixer 2.3, the soap dispenser 2.4 and the air jet hands-dryer 2.5 which is turned on by means of proximity sensor.

In the preferred embodiment for home and private settings, the intermediate module 2 and the lower module 1 are mutually installed in order to be usable on the same side and hence by only one user at a time.

Also the upper module 3 is configured for being usable by the same single user on the same side of the attained structure. Said upper module is provided with a container 3.1 made in the thickness of the module itself, made accessible from at least one door externally covered with at least one mirror 3.2. Above, a shower module 5 is arranged having a foldable arm 5.1 with a showerhead 5.2 at the distal end. Said foldable arm 5.1 can reversibly take on a first closed configuration in which it is included in the thickness of the shower module 5, and a second open configuration in which the distal end of the foldable arm 5.1 is substantially on the vertical of the center of the bathroom.

In order to use the shower, by means of said foldable arm 5.1, below the lower module 1 a floor module 4 is installed that is provided with the suitable shower plate 4.1.

Above, the bathroom is closed by a suitable ceiling module provided with at least one light and at least one exhaust fan adapted to be reversibly turned on upon command of a common switch.

On the side, the bathroom is delimited by one or by a plurality of side wall modules 6, depending on the planimetric form of the pre-existing wall. On one of said side wall modules 6, the access door 7 is arranged.

Said side wall modules 6 can be made of any one opaque, transparent or translucent material and can be provided with any one reversible mechanical coupling system adapted to allow the quick, stable and reversible coupling of a corresponding covering panel made of any one material. The interchangeable internal covering renders the bathroom of the present invention easily adaptable to any setting and architectural style.

Figure 9:
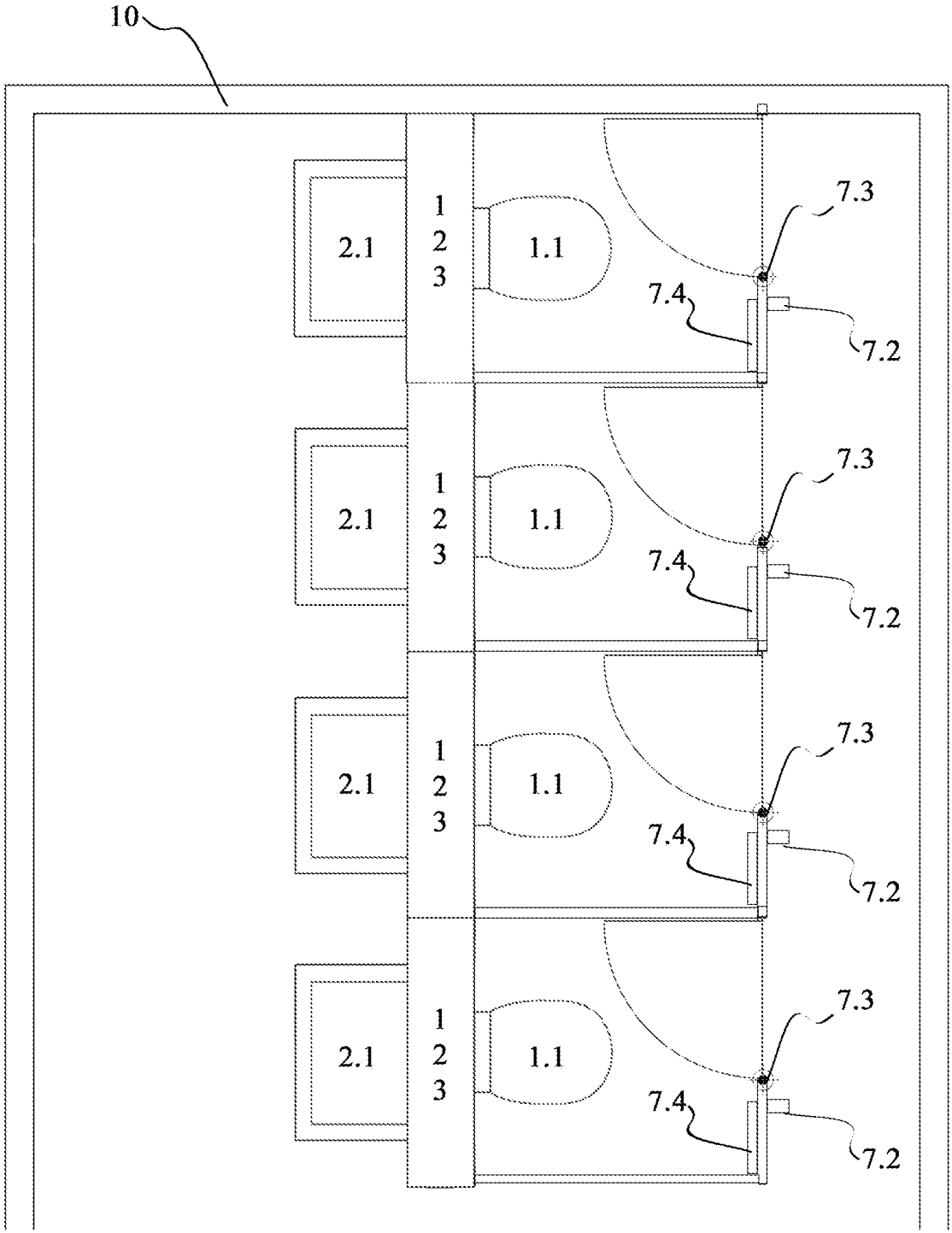
FIG. 9 shows the possibility to realize multiple in-line bathrooms for public spaces, open to the public, in which each kit is installed as in FIG. 5(*b*) and inside the bathroom a display 7.4 is installed, while externally a scanner 7.2 is adapted to unlock the locking device 7.3 of the door 7 of each bathroom only for the possessor of the code to be scanned.
Figure 10:
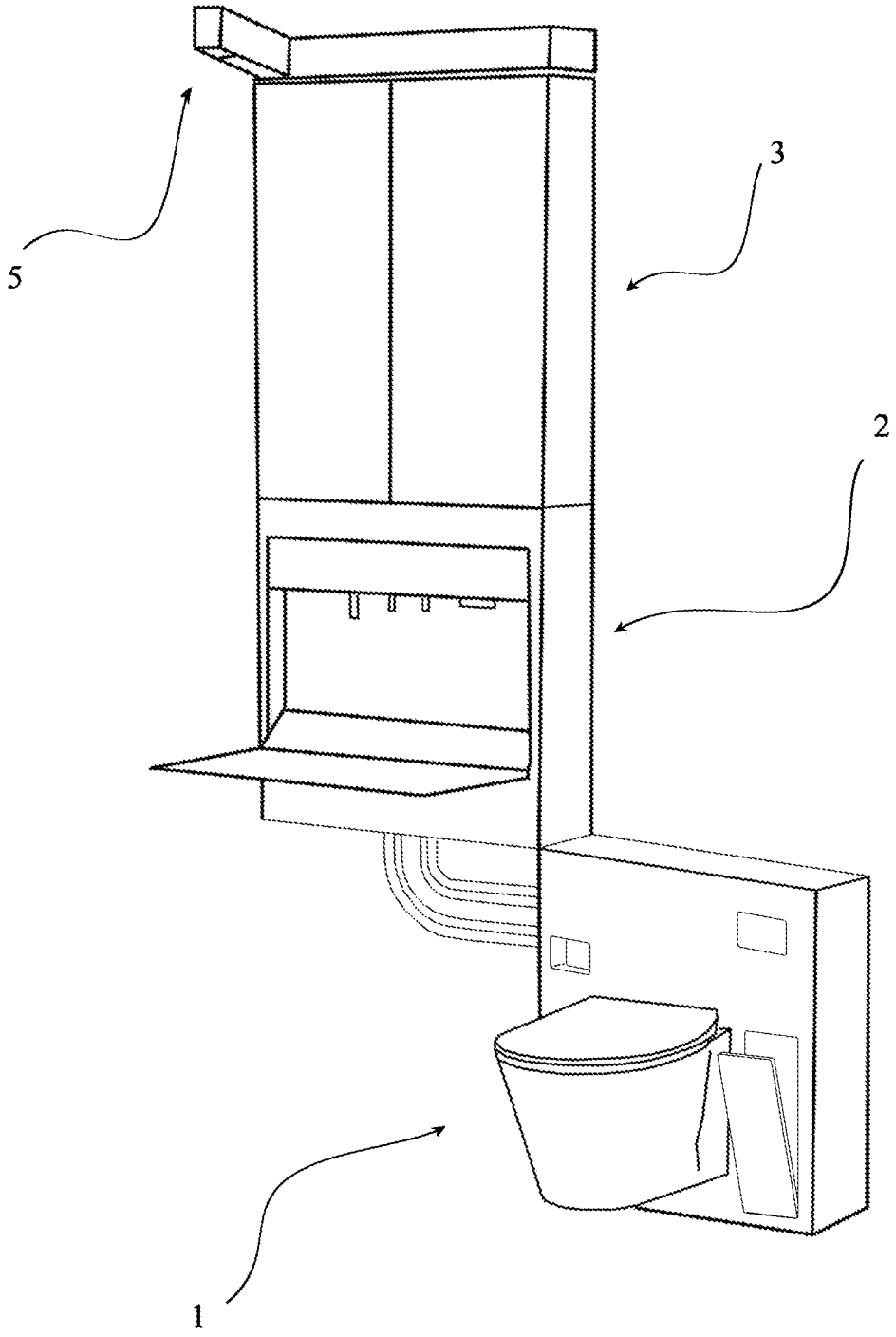
FIG. 10 shows a possible installation embodiment of a kit, according to the present invention, in which the lower module 1 is non-aligned with respect to the intermediate module 2.

In the case of use of the present invention for public spaces or spaces open to the public, reference is made to FIG. 9.

This involves a plurality of bathrooms, constituted by the same above-described modules, but arranged cantilevered with respect to the pre-existing wall 10 and in line one after the other. Said intermediate module 2, in this case, can be used on the opposite side with respect to the lower module 1, thus creating an ante-bathroom—hand-washing zone and a toilet zone.

Assuming that the bathroom in series of FIG. 9 is an airport bathroom, the scanner 7.2 placed externally is adapted to recognize the code borne on the airplane ticket of each passenger. Once scanned, the locking device 7.3 of the door 7 will allow the access to the first free bathroom of the line. In such a manner, the bathroom can be used only by the person who is actually using the services of the airport, and if not very frequented, the final bathrooms will remain unused, allowing the personnel to optimize the cleaning work. Inside each bathroom, a display 7.4 is installed which, among the various functions, can be adapted to report the travel details of the passenger who scanned the ticket over the scanner 7.2.

Independent of the embodiment of the present invention, it is preferably that at least four wheels are present in the kit, to be connected to the four corners of the complete structure in order to allow an easy movement thereof after having assembled the kit. Once the bathroom is positioned at the pre-selected installation point, technicians can proceed with the system connections in order to block the wheels or entirely disassemble them.

Finally, it is clear that modifications, additions or variations that are obvious for the man skilled in the art can be made to the invention described up to now, without departing from the protective scope that is provided by the enclosed claims.

The invention claimed is:

1. A prefabricated modular kit, reversibly assemblable, configured for installation of a bathroom, at a pre-existing wall or by a self-standing installation, said kit comprising:

at least one lower module provided with a front surface on which at least the following are installed:

a toilet bowl, a discharge device configured to activate flushing, a roll-holder configured to contain a common toilet paper roll, a container integrated in the volume of said lower module and accessible by a common door, a tiltable door configured to contain a brush or a hydro-brush configured to clean the bowl and integrated in the volume of said lower module, one or more of a sprayhead and a water spray emitted within the toilet bowl in order to act as a bidet, said sprayhead being laterally placed with respect to said toilet bowl and configured to be grasped by a user in order to act as the bidet, water connections provided in a rear surface or a lateral surface thereof, the water connections being configured to convey hot and cold water towards the upper surface of said lower module, a discharge duct of the toilet bowl configured to discharge towards one of the lateral surface, the rear surface, and a floor depending on a position of the fecal connection of a building in which the bathroom is installed;

at least one intermediate module, reversibly installable above said lower module, in an axially aligned or non-aligned position, at which at least one overturnable or hidden bellows sink surface is installed, the at least one overturnable or hidden bellows sink surface configured to take a first closed configuration in which said intermediate module has a completely flat surface, said overturnable or hidden bellows sink surface being configured to rotate around a lower side until the overturnable or hidden bellows sink surface takes a second open configuration in which said overturnable or hidden bellows sink surface is substantially parallel to the floor and the following are made accessible to the user:

at least one faucet equipped with a mixer, at least one soap dispenser, and at least one air jet hand dryer, said at least one faucet, said at least one soap dispenser, and said at least one air jet hand dryer being configured to be reversibly activated, in an automatic manner, due to proximity sensors configured to detect a presence of hands of the user, said at least one intermediate module being configured to be positioned with said sink facing a same side or an opposite side of the toilet bowl;

at least one upper module, reversibly installable above said at least one intermediate module, at which at least one container is installed, obtained within the volume of said upper module, made accessible by at least one openable door at which at least one mirror is installed, said at least one upper module being configured to be positioned with the container openable on the same side or the opposite side as said sink;

at least one shower module placed above or laterally with respect to said at least one upper module, the at least one shower module being provided with a foldable arm configured to be placed back in a first closed configuration in which the foldable arm is entirely comprised in the volume of said at least one shower module, said foldable arm being configured to rotate with respect to the horizontal plane, reversibly taking on a second open configuration in which a distal end is placed along the vertical of a shower plate installed on the lower module, said foldable arm being configured to be extended towards an opening side or the opposite side of said container, said foldable arm having, at the distal end thereof, a showerhead configured to act as a shower; and a floor module, constituted by a common shower plate provided with a drain, the floor module being configured to be positioned below said at least one lower module on a side where said foldable arm is configured to be opened, said upper, intermediate, lower, floor, and shower modules having preformed electrical, hydraulic and drain systems configured to connect between the upper, intermediate, lower, floor, and shower modules themselves and between said upper, intermediate, lower, floor, and shower modules and the pre-existing wall or the floor of the building in which said bathroom is installed, and the water connections of the at least one lower module are configured to be connected with water connections arranged on the at least one intermediate module and the at least one upper module.

2. The prefabricated modular kit according to claim 1, further comprising a ceiling module configured to be installed above said upper module or above said shower module to close a space of the bathroom attained by walls of the at least one lower module, the at least one intermediate module, and the at least one upper module of said kit, said ceiling module being provided with at least one light and at least one exhaust fan configured to be reversibly turned on upon command of a common switch or turned on automatically when a sensor detects a presence of the user inside the bathroom.

3. The prefabricated modular kit according to claim 1, further comprising at least one side wall module configured to be installed laterally and in front of said upper, intermediate, and lower modules to delimit a space of said bathroom, said at least one side wall module being made of any one opaque, transparent or translucent material.

4. The prefabricated modular kit according to claim 3, further comprising at least one side wall module door configured to be installed at one of said at least one side wall module in order to allow access to said bathroom.

5. The prefabricated modular kit according to claim 3, wherein said toilet bowl is a bellows toilet bowl configured to be folded when not in use, rendering said bathroom usable for handicapped users in wheelchairs, the at least one side wall module is provided with handles configured to enable said handicapped users to approach sanitary appliances, said floor module being provided with a reversible extractible ramp configured to allow said handicapped user to go beyond a step formed by said floor module with the floor.

6. The prefabricated modular kit according to claim 1, further comprising at least four wheels, placed in contact with the floor at four vertical edges of a structure formed by the prefabricated module kit to allow positioning of the bathroom, once assembled, and configured to be locked in order to allow connection of the bathroom to the preformed electrical, hydraulic and drain systems of the building.

7. The prefabricated modular kit according to claim 1, further comprising a plurality of radiators, actuatable by a button or through an automated system, configured to allow said bathroom to function a dry sauna or a steam room.

8. The prefabricated modular kit according to claim 4, further comprising a scanner disposed outside said bathroom, at said side wall module door, said scanner being connected to a lock of said side wall module door and being configured to allow opening of said side wall module door only by users possessing a code to be scanned on said scanner.

9. The prefabricated modular kit according to claim 3, further comprising a display disposed inside said bathroom, at any one of said at least one side wall module, said display being configured to report information for the user inside the bathroom.

10. The prefabricated modular kit according to claim 4, wherein the modular kit allows installation of a plurality of bathrooms in a linear arrangement, and wherein the modular kit further comprises a locking device for the lock of the side wall module door of each bathroom; said locking devices (7.3) being adapted to allow the opening of the door (7) of one of said bathrooms in line only if the bathroom precedingly placed is already occupied.

11. The prefabricated modular kit according to claim 1, further comprising a plurality of diffusers configured to spread through the air inside said bathroom, in a timed and controlled manner according to predetermined settings, a deodorant or any one essence, with therapeutic functions.

12. The prefabricated modular kit according to claim 2, further comprising at least one light configured to change color for chromotherapeutic purposes, said at least one light being actuatable by a button or through an automated system.

13. The prefabricated modular kit according to claim 1, further comprising at least one audio speaker actuatable by a button or through an automated system for diffusion of music inside said bathroom.

14. The prefabricated modular kit according to claim 4, further comprising at least one external light disposed at said at least one side wall module door, connected to a common sensor configured to recognize a presence of the user inside the bathroom, said light being configured to signal, by pre-established colors, a presence or a lack of presence of the user inside the bathroom.

15. The prefabricated modular kit according to claim 1, further comprising a hydraulic and electrical system configured to connect a common washing machine, defining a laundry space inside the bathroom, the hydraulic and electrical system being disposed at the at least one lower module.

16. The prefabricated modular kit according to claim 1, wherein said floor module is provided with a lifting system configured to adjust the height thereof during assembly, in a stable but reversible manner, from a minimum height of 3 cm to a maximum height of 30 cm.

17. The prefabricated modular kit according to claim 16, wherein a plurality of lower modules of the at least one lower module is arranged in sequence and is installed on a plurality floor modules at different heights, configured to create a slope to convey each of the discharge ducts of each of the lower modules towards the same fecal connection.

18. The prefabricated modular kit according to claim 2, wherein said at least one upper module, at least one intermediate module, and at least one lower module include walls, hermetic seals being provided between the at least one upper module, the at least one intermediate module, and the at least one lower module, and the kit further comprises a shower emission system for a hygienizing liquid configured to clean every surface inside said bathroom.

19. The prefabricated modular kit according to claim 18, wherein the at least one upper module, the at least one intermediate module, and the at least one lower module each comprise walls, a connection between all of the walls and the at least one upper module, the at least one intermediate module, and the at least one lower module is curved, and said floor module is configured to convey all the hygienizing liquid that runs from the walls towards the drain.

* * * * *